United States Patent [19]

Young

[11] Patent Number: 4,866,891

[45] **Date of Patent: * Sep. 19, 1989**

[54] PERMANENT NON-REMOVABLE INSULATING TYPE CONCRETE WALL FORMING STRUCTURE

[75] Inventor: David A. Young, Glen Ellyn, Ill.

[73] Assignee: Young Rubber Company, Naperville, Ill.

[ * ] Notice: The portion of the term of this patent subsequent to Nov. 17, 2004 has been disclaimed.

[21] Appl. No.: 121,000

[22] Filed: Nov. 16, 1987

[51] Int. Cl.[4] ..... E04B 2/00

[52] U.S. Cl. ..... 52/105; 52/309.12; 52/426

[58] Field of Search ..... 52/426, 424, 425, 258, 52/259, 249, 309.12, 85, 204

[56] References Cited

U.S. PATENT DOCUMENTS

| | | | |
|---|---|---|---|
| 2,351,615 | 6/1944 | James | 52/258 |
| 3,238,684 | 3/1966 | Wood | 52/426 |
| 3,518,801 | 7/1970 | Redey | 52/425 |
| 3,788,020 | 1/1974 | Gregori | 52/309.12 |
| 4,229,920 | 10/1980 | Lount | 52/309.12 |
| 4,439,967 | 4/1984 | Dielenberg | 52/309.12 |
| 4,516,372 | 5/1985 | Grutsch | 52/309.12 |
| 4,604,843 | 8/1986 | Ott | 52/309.12 |
| 4,655,014 | 4/1987 | Krecke | 52/309.12 |
| 4,665,666 | 5/1987 | Hampton | 52/309.12 |

FOREIGN PATENT DOCUMENTS

| | | | |
|---|---|---|---|
| 1484271 | 5/1969 | Fed. Rep. of Germany | 52/426 |
| 69590 | 11/1958 | France | 52/258 |
| 1004061 | 9/1965 | United Kingdom | 52/715 |

*Primary Examiner*—Henry E. Raduazo

*Attorney, Agent, or Firm*—Charles F. Meroni, Jr.

[57] ABSTRACT

A modular synthetic plastic concrete form structure for forming a concrete wall or free form or an enclosure having a curved corner. One form of the structure includes a pair of modular concrete impervious foamed forming panels each comprised of a series of modular foamed concrete forming sections stacked on top of one another and also disposed in end-to-end relation. The structure further includes a foamed curved corner form structure comprised of a series of arcuately curved corner sections stacked on top of one another providing a radially outer continuous curved corner area for forming a curved concrete corner. The sections each have means on upper and lower edges and at opposite vertical edges of interlocking the section in stacked end-to-end engagement with one another. The panels are positioned in spaced opposed relation. Ties connect the panels in transversely spaced relation and with the panels and the ties being permanently attached with the concrete poured between the panels as a reinforcing and heat insulator.

27 Claims, 6 Drawing Sheets

PERMANENT NON-REMOVABLE INSULATING TYPE CONCRETE WALL FORMING STRUCTURE

BACKGROUND OF THE INVENTION

Field of the Invention

The present invention relates to a new and improved synthetic plastic concrete forming system for forming curved concrete wall structures. The present invention also concerns a new and improved combination of a synthetic plastic concrete form structure for forming curved walls and concrete wall ties uniquely secured therewith for permanent assembly with a concrete structure formed in the form. Still another part of the invention relates to a new and improved synthetic plastic concrete form structure for forming curved walls with the form structure having ties for rigidifying the same and with shock absorbers between forming sections and the ties to enable the concrete to be poured into the form to minimize the impact applied to the ties.

According to other features of my invention, I have developed a new and improved cushioning structure for cushioning the impact received by the synthetic plastic concrete wall ties whereby the wall structure for forming curved walls has a reduced thickness at a point immediately below where the end of each wall tie engages in its slot provided in the synthetic plastic wall panel so that when poured concrete strikes the wall tie, the wall tie can move downwardly at the area wher the thickness of the panel has been reduced to cushion the impact of the concrete upon the wall tie and the panels without cracking and/or breaking the panels.

According to still other important features of my invention, I have provided a synthetic plastic concrete form structure for forming curved walls with structure for enabling the panels to be stacked upon each other and to resist leakage through the castellation joint should a heaving occur between the curved synthetic plastic panels whereby one panel might be caused to be slightly lifted relative to the other panel to which it is engaged.

Yet another feature of my invention is to provide a new and improved castellation structure for joining stacked curved panels together where concrete dams are built into the castellation to inhibit concrete leakage exteriorly of the joined curved panels for forming curved concrete walls.

Yet another important feature of my invention concerns a new and improved form closure panel for use with my synthetic plastic concrete forming system whereby synthetic plastic closure panel can be inserted between a pair of confronting panels at any given point along the length of the panels and whereby the closure panels serves to contain concrete within the concrete forming structure for forming concrete walls with curved corners.

Still another important feature of my invention is to provide a new and improved synthetic plastic concrete forming system for forming concrete wall with insulated curved corners where its components and particularly the panels can be shipped in compact knock-down from to minimize shipping costs.

Still another feature of my invention is to provide a new and improved connector structure for connecting a closure panel with opposed concrete panels to provide a modular synthetic plastic concrete forming system for forming concrete walls with curved corners.

Yet still another feature of my invention concerns a new and improved connecting structure for forming concrete walls with insulated curved corners for joining ends of synthetic plastic concrete panels in end-to-end relation such that accidental disassembly of the end engaged panels can be resisted.

A still further feature of my invention concerns my new and improved synthetic plastic concrete form structure for forming curved wall components for enclosures and/or door covers or top closure structures.

In the past, it will be appreciated that different types of foamed plastic concrete forming systems have been used in industry and, in this connection, attention is drawn to U.S. Pat. Nos. 3,552,076 and 3,788,020. These patents relate generally to concrete forms formed from low density foamed plastic and polymeric material but where the forms do no possess the improvements herein described and illustrated.

SUMMARY OF THE INVENTION

In a modular synthetic plastic concrete form structure for forming a concrete wall having a curved corner, wherein the improvement comprises a pair of modular concrete impervious foamed forming panels each comprised of a series of modular foamed concrete forming sections stacked on top of one another and also disposed in end-to-end relation, a foamed curved corner form structure comprising a series of said forming sections positioned at right angles to one another providing a right angled corner joint and arcuately curved corner sections stacked on top of one another providing a continuous curved corner radially outwardly of the right angled corner joint, the sections each having means on upper and lower edges and at opposite vertical edges for interlocking the section in stacked end-to-end engagement with one another, the panels being positioned in spaced opposed relation, and tie means connecting the panels in transversely spaced relation and with the panels and the tie means being permanently attached with the concrete poured between the panels as a reinforcing and heat insulator.

In a modular synthetic plastic concrete form structure for forming a concrete wall having a curved corner the improvement of the structure including a pair of modular concrete impervious foamed forming panels each comprised of a series of modular foamed concrete forming sections stacked on top on one another and also disposed in end-to-end relation, the structure further including a foamed curved corner form structure comprised of a series of arcuately curved corner sections stacked on top of one another providing a radially outer continuous curved corner area for forming a curved concrete corner, the sections each have means on upper and lower edges and at opposite vertical edges for interlocking the section in stacked end-to-end engagement with one another, the panels being positioned in spaced opposed relation, and ties connecting the panels in transversely spaced relation and with the panels and the ties being permanently attached with the formed concrete poured between the panels as a reinforcing and heat insulator.

DESCRIPTION OF THE PREFERRED EMBODIMENTS

Figure 1:
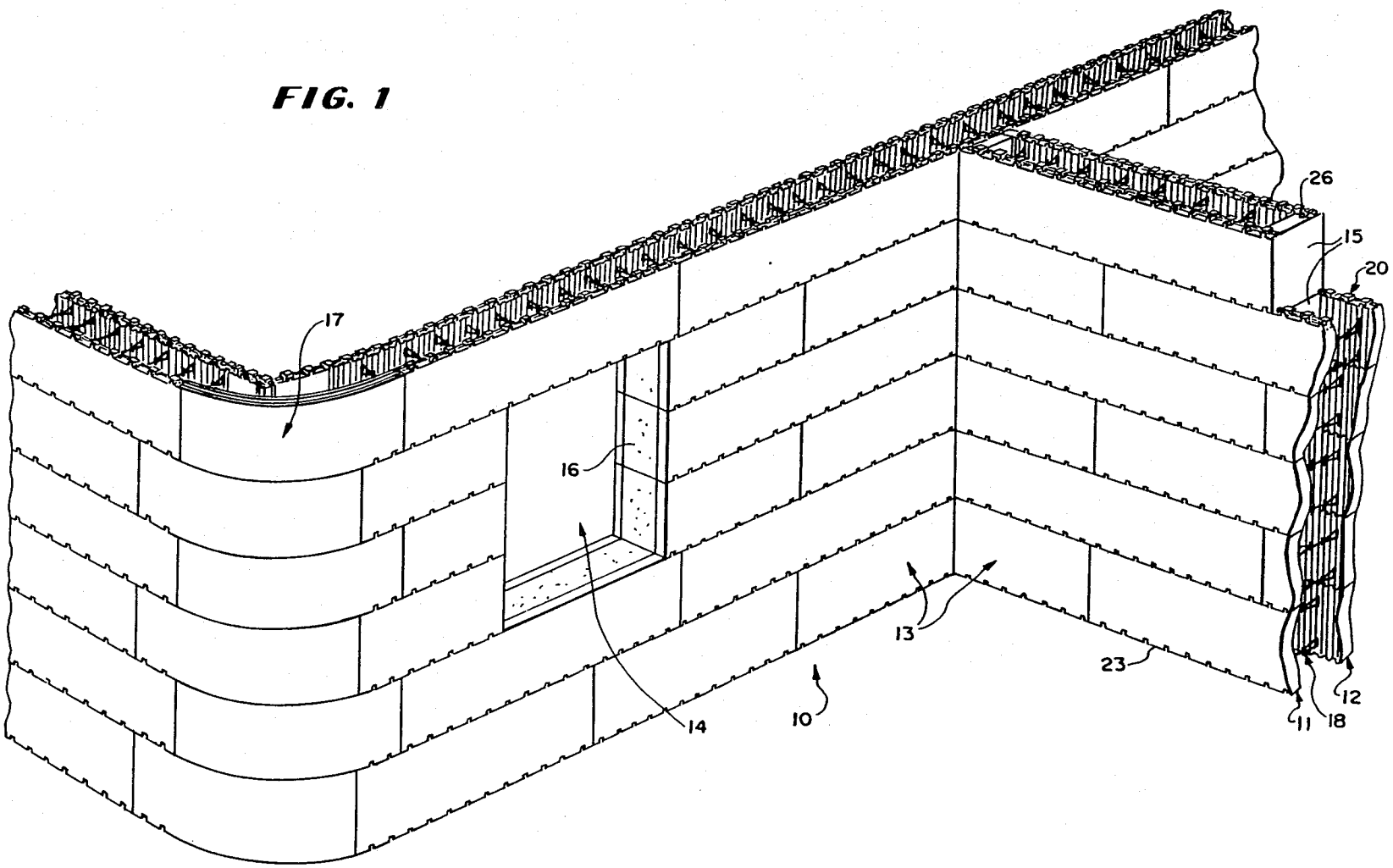
FIG. 1 is an enlarged framentary cross-sectional view of a modular foarmed plastic concrete form structure embodying important features of my invention.

The reference numberal10, as seen in FIG. 1, designates generally a modular foamed plastic concrete form structure for forming concrete wall structures having curved corners. The structure that is shown in FIG. 1 is also shown in my co-pending U.S. application for patent entitled: "AN INSULATING NON-REMOVABLE TYPE CONCRETE WALL FORMING STRUCTURE AND DEVICE AND SYSTEM FOR ATTACHING WALL COVERINGS THERETO", Case Nos. 85600-2, U.S. Ser. No. 799,932 and 85601-2, U.S. Ser. No. 799,933 which are co-pending with the present application. The disclosures of my co-pending applictions are incorporated by reference in the present application.

The structure 10 is comprised of a pair of modular concrete forming panels 11 and 12 which are spaced from one another and which when properly installed serve to act as a form into which concrete may be poured. The panels are each comprised of a series of modular concrete forming sections 13 which are all identical to one another with certain exceptions, as hereafter described. These sections are adapted to be cut and arranged so as to enable window openings 14 to be easily constructed. Cooperable with the panels 11 and 12 are end closure panels 15 which extend transverely between the forming panels 11 and 12 and between the forming sectiosn 13 so as to confine poured concrete. It will further be seen that the window openings 14 are also provided with closure panels 16. All of the panels 11, 12, the sections 13, the closure panels or end pieces 15, the window panels 16 and curved corner panels 17 are comprised of foamed plastic preferably an expandible polystyrene. This material has been found to have unique insulating properties and strength so as to enable concrete walls to be better insulated to impeded transmission of heat through a formed wall as will be further described at another point therein.

In order to properly reinforce the concrete forming structure 10, I have developed a new and improved wall tie 18 which is comprised of 20% calcium carbonate filled polypropylene as a preferred embodiment.

My thermal wall system is a whole new concept in energy efficient building technology. The building block sections of expended polystyrene serve as a permanent form for concrete. This system of construction is for use where energy conservation is for use where energy conservation and speed of construction are important.

Expanded polystyrene or EPS is a closed cell, rigid, lightweight cellular plastic, white in color, that is molded into various shapes with steam and pressure. Thermal wall system panels are made of modified polystyrene. The density of the panels range between 1.7 and 2.0. Typical physical properties of EPS insulation is given in Table 1 below. Like all organic materials, EPS is combustible and should not be exposed to flame or other ignition sources.

TYPICAL PHYSICAL PROPERTIES OF EPS

| Property | | Units | ASTM Test | Density (pcf) 1.0 | 1.25 | 1.5 | 2.0 |
|---|---|---|---|---|---|---|---|
| Thermal Conductivity | at 25 F. | BTU/(ht) | C:77 or | 0.23 | 0.22 | 0.21 | 0.20 |
| K Factor | at 40 F. | (sq ft)(F/in) | C518 | 0.24 | 0.235 | 0.22 | 0.21 |
| | at 75 F. | | | 0.26 | 0.255 | 0.24 | 0.23 |
| Thermal Resistance | at 25 F. | at 1 inch | | 4.35 | 4.54 | 4.76 | 5.00 |
| Values (R) | at 40 F. | thickness | — | 4.17 | 4.25 | 4.55 | 4.76 |
| | at 75 F. | | | 3.85 | 3.92 | 4.17 | 4.35 |
| Strength Properties | | | | | | | |
| Compressive 10% Deformation | | psi | D1621 | 10–14 | 13–18 | 15–21 | 25–33 |
| Flexural | | psi | C203 | 25–30 | 32–38 | 40–50 | 35–75 |
| Tensile | | psi | D1623 | 16–20 | 17–21 | 18–22 | 23–27 |
| Shear | | psi | D732 | 18–22 | 23–25 | 26–32 | 33–37 |
| Shear Modulus | | psi | — | 280–320 | 370–410 | 460–500 | 600–640 |
| Modulus of Elasticity | | psi | — | 180–220 | 250–310 | 320–360 | 460–500 |
| Moisture Resistance | | | | | | | |
| WVT | | percent | C355 | 12–30 | 11–28 | 09–25 | 06–15 |
| Absorption (vol) | | percent | C272 | less than | less than | less than | less than |

-continued

TYPICAL PHYSICAL PROPERTIES OF EPS

| Property | Units | ASTM Test | Density (pcf) 1.0 | 1.25 | 1.5 | 2.0 |
|---|---|---|---|---|---|---|
| Capillarity | — | — | none | none | none | none |
| Coefficient of Thermal Expansion | in/(in)(F) | D696 | 0.000035 | 0.000035 | 0.00001 | 0.000035 |
| Maximum Service Temperature | °F. | — | | | | |
| Long term | | | 167 | 167 | 167 | 167 |
| Intermittent | | | 180 | 180 | 180 | 180 |

At values based on available from American Chemical Corporation ARCO Chemical Company and BASF Corporation The basic building components of my thermal wall system are the two solid 2" panels 11 and 12 of polystyrene connected together with high impact plastic ties 18. The length of the tie 18 determines the width of the concrete wall. Each block or section 13 has male castellations 20 along its top edge or surface 21 and matching female castellations 20' along its under edge 23 (FIG. 1). The blocks or sections 13 are placed one on top of the other and pressed together using simple hand pressure. The castellations mesh together creating a completely smooth surface that is interlocked. The vertical ends of the block or section 13 are tongue 24 and groove 25 (FIG. 5) and interlock as well. The blocks or sections 13 are erected directly on top of footings or on the floor slab, as design dictates. The footings must be level and flat. When placing concrete, particular care should be taken in the first lift to check the horizontal and vertical levels.

Each of the end closures 15 have vertically extending alternating hooked shaped ribs and grooves generally indicated at 26 which are shaped like and complimentary to hook shaped ribs 27 and hooked shaped grooves 28 (FIG. 8) to enable opposite ends of the end closures 15 to be slid into interlocked assembly with the opposed sectins 13, 13. The sections have the ribs 27 and grooves 28 formed integral with the associated section 13 and when set up, the ribs 27 and the grooves 28 on the opposed panels 11 and 12 confront one another.

Figure 4:
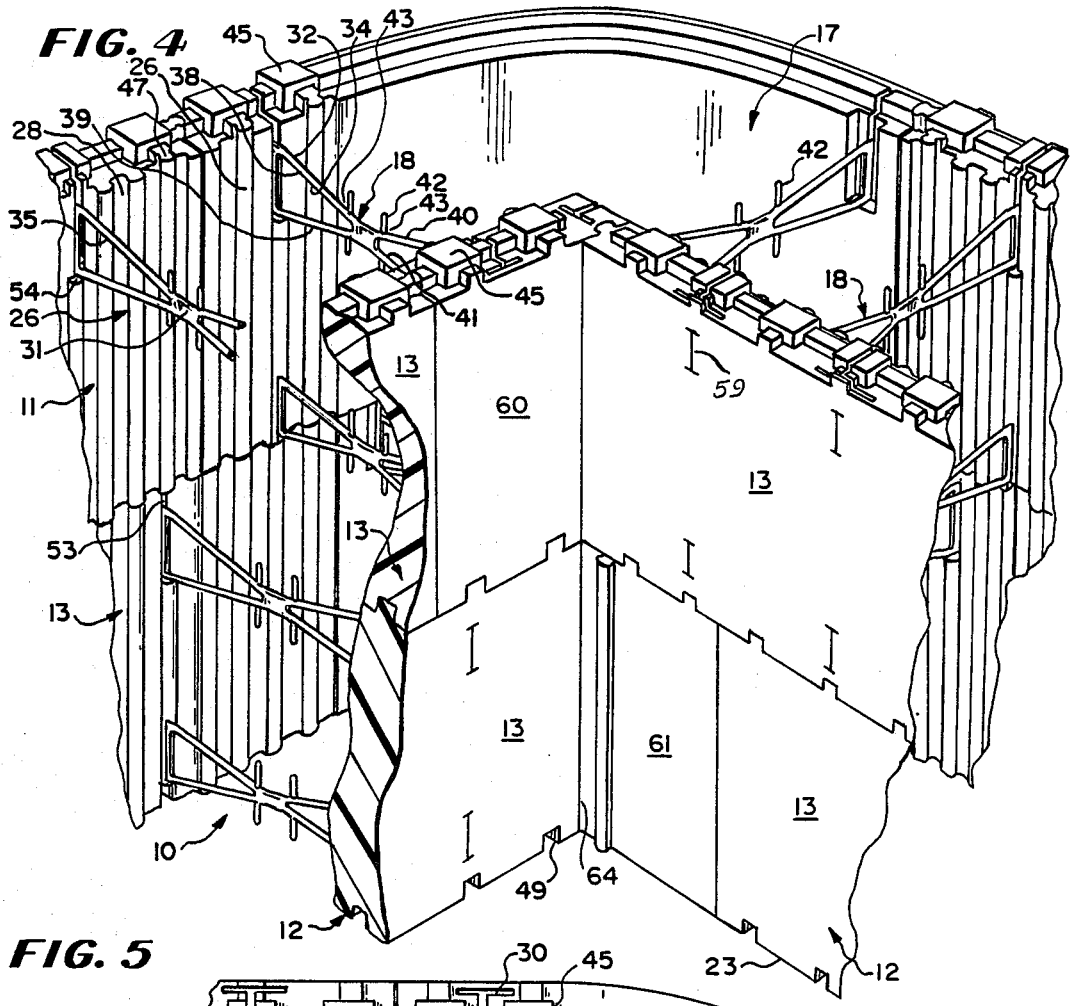
FIG. 4 is an enlarged fragmentary partial sectioned view of the concrete form structure shown in FIG. 1 and embodying important features of my invention.

The ties 18 are adapted to coact with upper and lower rows of T-shapedslots 29 which are formed in each of the sections 13. The slot29 opens on an inner side so that the T-shaped slots oppose one another when two sections 13—13 are placed in opposed relation such as is shown in FIG. 4. The ties 18 are provided with T-shaped tie ends 30—30 which have a configuration that matches the shape of the slots 29 so as to be slideably engageable together when assembled with the sections. The ties 18 when engaged with the opposed sections along their upper and lower edges provide a sturdy concrete form structure.

Figure 5:
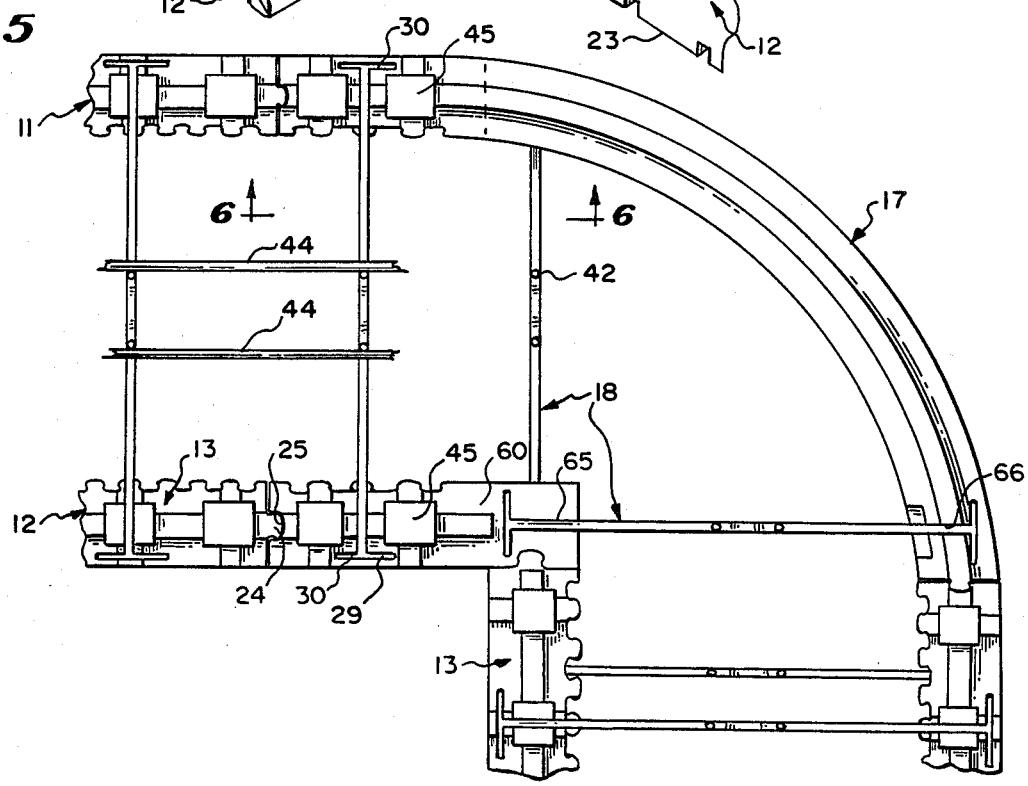
FIG. 5 is a fragmentary top plan view of the concrete form structure shown in FIG. 4.

It will be noted from comparing FIGS. 4 and 5 of my aforesaid co-pending application, U.S. Ser. No. 799,933 that two different types of ties identified as ties 18 and 18' are there disclosed. Only tie 18 is shown here but either one may be used. These ties are essentially identical except that one tie 18 is shorter and can be used where narrower concrete walls are to be formed such as having a thicknessof 8". The longer ties 18 are adapted to be used in the formation of concrete walls having a thickness of 10". The length of the ties can be varied as required. The two ties are similar in construction and the differences are pointed out in my other application.

The ties 18 have an intermediate or mid-web section 31, and a pair of triangular truss sections 32 are disposed on opposite ends of the mid-section 31' in integral one piece assembly therewith. The intermediate web section 31' joins the truss sections at the apexes of triangules of the triangular truss sections. As stated, the triangular truss sections 32 and 33 define triangular truss openings 34 and 35. It is these openings that have been created to enable concrete to flow freely through the ties in an unimpeded manner so that the ties will not act as dams to confine the flow of liquid concrete in the molds or forms as the concrete is poured.

The triangular truss sections 32 and 33 terminate in end truss portions 36 and 37 which in turn merge into the T-shaped tie ends 30—30. Each of the tie ends includes a cross piece portion **30*a* and a stem portion 30*b*. The truss sections are further defined by truss legs 38, 39, 40 and 41** which are all preferably of a diameter of approximately 3/16".

The ties 18 are also provided with upstanding fingers 42—42 with a pair of the fingers being mounted on each edge of the tie and more particularly are joined to adjacent truss legs. The fingers 42 coact with the truss legs so as to form V-shaped notches 43 for receiving reinforcing rods 44. It has been found that where the ties are constructed so as to be provided with the fingers 42 defining the notches 43 that the concrete rods 44 can be more fixedly located at the point in time when the liquid concrete is poured into the form so that the reinforcing rods will not bounce and move as the concrete C is poured thereon.

The shorter tie 18' in my co-pending application differs from the tie 18 in that it is only provided with a single pair of upstanding fingers and thesefingers extend above and below tie mid-section 47.

The ties 18 and 18' shown in my co-pending application are otherwise identified as the long tie 18 and the short tie 18' are preferably constructed having the following approximated dimensions:

| | Length of Tie | Height of Tie | Thickness of Flat End | Width of Stem of T-shaped End |
|---|---|---|---|---|
| Long Tie | 11" | 2 3/16" | 3/16" | 1 5/16" |
| Short Tie | 9" | 2 3/16" | 3/16" | 1 ¼" |

| | Width of Intermediate Truss Section | Length of Finger | Diameter of Finger |
|---|---|---|---|
| Long Tie | 1 13/16" | ⅝" | 3/16" |
| Short Tie | 1 ¼" | ⅝" | 3/16" |

| | Length of Vertical Truss Legs | Length of Diagonal Truss Legs | Diameter of Diagonal Truss Legs |
|---|---|---|---|
| Long Tie | 1 ¾" | 3 1/16" | 3/16" |
| Short Tie | 1 ¾" | 2 ⅜" | 3/16" |

My thermal wall structure introduces a new building product made of expandable polystyrene which serves as a permanent form for concrete construction. This products main advantages are its speed of erection and the very high thermal insulation properties attained (R-Value of 20+).

Similar products have been used extensively in Switzerland, Belgium, France, Germany, Venezuela, Australia and now the United States. It has been in use for nearly 20 years. It is a simple building system: Hollow blocks made of ARCO Dylite Expandable Polystyrene, with a flame retardant additive, are erected "Lego" fashion by means of their toothed tops and grooved bottoms. Plastic ties hold the sides together and the length of the tie determines the width of the cavity or wall, the blocks are interlocked both horizontally and vertically. Once erected, concrete is poured into the cavity of the wall creating an insulated load bearing structure.

My thermal wall building blocks or sections 13 are composed of panels of EPS (Expandable Polystyrene) that are 2" thick, 12" thigh and 40" or 20" long. The density is nearly twice that of conventional insulation board. A whole range of exterior finishes can be applied. Scores of elastomeric coatings and stucco finishes may be used as well as siding or paneling. Interiors are finished with drywall, plaster, tile or in any other traditional manner.

My thermal wall structure is an advanced system of construction for use where energy conservation (by reduction of thermal transmission) and speed of construction (reduced labor costs) are important.

The inherent low thermal fluctuations ensure that the risk of cracking of any external rendering and internal plaster-work are non-existent. The maximum possible expansion is 0.2 mm/m.

Excellent noise and impact sound reduction is also an important advantage of the Thermal Wall System. Remembering that a difference of 10 dB almost halves the volume of noise. 350 Ka/m2 Thermal Wall 250 mm is at 49 dB.

Expandable Polystyrene does not rot and when used properly in building construction it is not subject to any other kind of deterioration while in service.

Panels of "Dylite" Expandable Polystyrene are 2" thick, 12" high and 40" or 20" long. The horizontally spaced rows of "t" or T-shaped slots 29 are disposed along the top and bottom of each section. T-shaped ends 30—30 of the ties 18 are inserted into the slots 29. These ties 18 hold the sections 13 and the panels 11 and 12 together and also determine the width of the wall. Each blocks or sections 13 have the castellations 20 along its top surface and matching castellations along the underside as previously described. The blocks 13 are placed one on top of the other and pressed together using simple pressure; the castellations mesh together creating a completely smooth surface and solid structure. The blocks are erected directly on top of footings or on a floor slab, as design dictates. The footings must be as level and flat as possible. When pouring concrete, particular care should be taken in the first three feet poured to check the horizontal and vertical levels, this is most important, as small errors and variations in the early levels will be greatly increased in height. The lightness of the blocks or sections 13 and the flexibility of them means erection can be both fast and simple.

It will be appreciated that the vertical height of each section 13 can be of the order of 12¾" which will include the vertical dimension of the male castellations 20. When the panels are interlocked together, the male castellations become imbedded in the castellation cavities and the vertical heightof the panel then becomes 12" when measured from between the horizontal jointsor seams (FIG. 1) when the sections are in stacked assembly as shown. It will further be appreciated that the closure panels 15 have castellations 20 and castellation cavities 20' which are configurated in the same way as the ones that have been described as being provided for the section 13. The operation of the closure panel castellation structure is the same so that the closure panels can also be stacked and locked together in the same manner as the side sections 13.

For corners, windows, door openings and t-junctions a special made "endpiece" is also made of expandable polystyrene and is inserted into the end of the block. It slides into the block and acts as a bulkhead for concrete. It is held in place by surface corrugations on the insides of the block panels.

The corners are formed by interlocking blocks perpendicular to one another (90°) and inserting endpieces to bulkhead the concrete. With a 10" wall, rounded corners are available by use of my specially made corner block or section 17.

Figure 7:
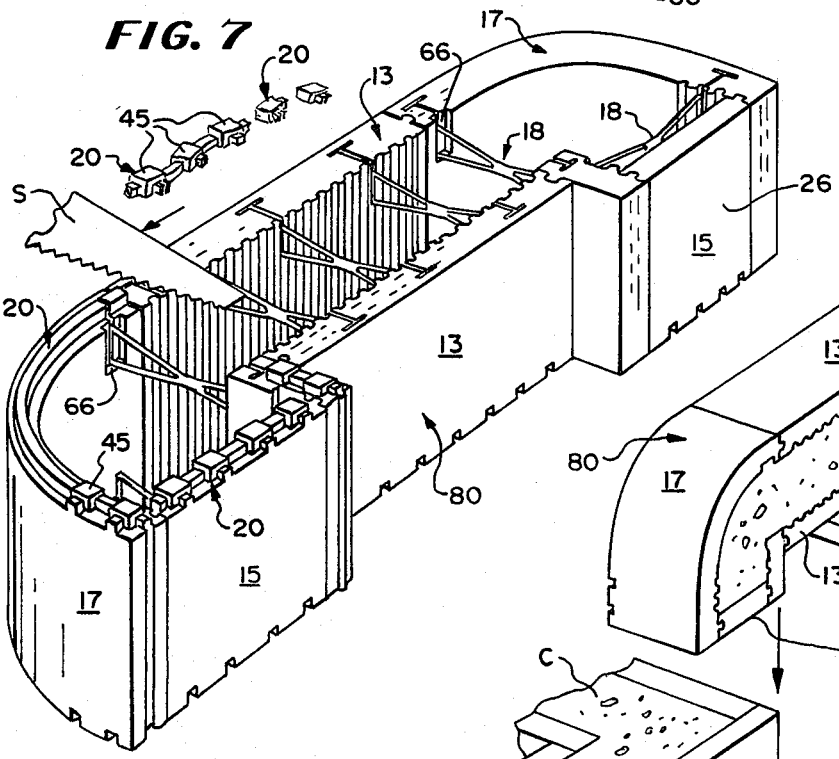
FIG. 7 is an enlarged fragmentary partially exploded view illustrating the way in which the concrete form structure can be modified for the purpose of building an archway for a building structure in accordance with other features of my invention.

Thermal wall blocks or sections 13 or the castellations 20 can be cut quickly and easily with any conventional hand saw S (FIG. 7). Sanding down the edge with a coarse abrasive block ensures a smooth tight fit. The castellations 20 maybe removed as shown in FIG. 7, as will be further described to produce other types of concrete forms as shown generally at 80 in FIGS. 7 and 8.

The blocks or sections 13 are stacked to the desired height of 8 to 10 foot and are filled with regular concrete by means of a concrete truck and chute or with a concrete pump. A super plasticizer additive is recommended to aid in flowability of the concrete mix without detriment to the strength of the concrete. The concrete should be placed in "lifts" or layers of 4 foot, at a rate of 8 to 10 foot per hour.

Figure 2:
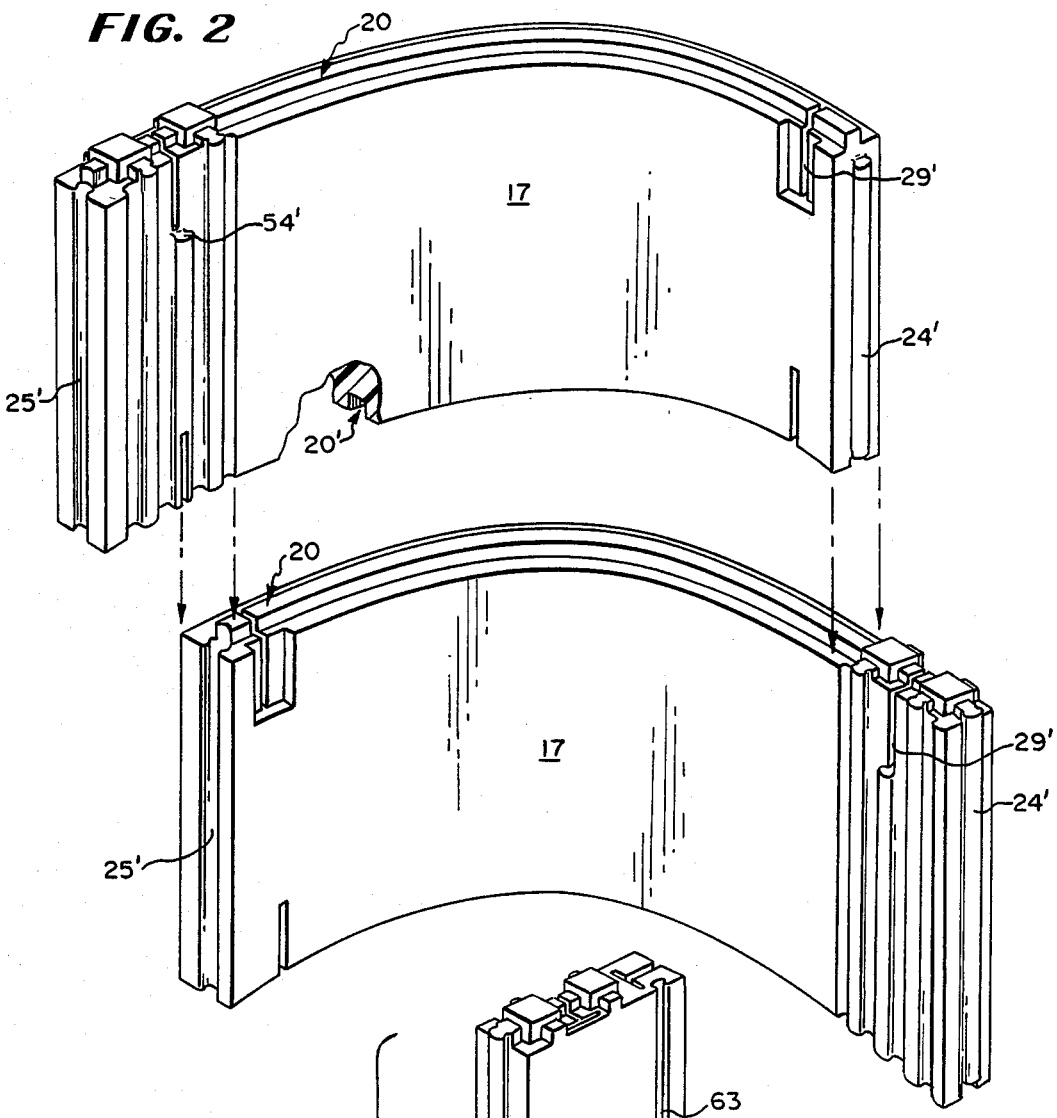
FIG. 2 is an enlarged exploded perspective view of curved corner sections of my modular concrete formed structure embodying importaant features of my invention.
Figure 6:
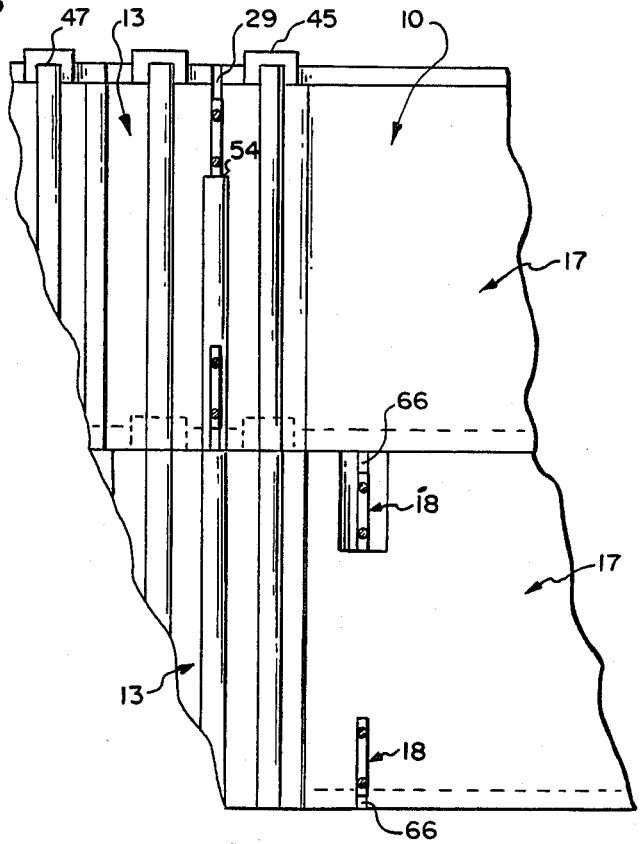
FIG. 6 is an enlarged fragmentary partially sectioned interior plan view of the concrete form structure as viewed on the line 6—6 looking in the direction indicated in the arrows as seen FIG. 5.

The corner section 17 provides a closure for the outside group of modular concrete forming panels 11 as seen in FIG. 4. These panels are further shown in an exploded form in FIG. 2. The same castellation S including the male and female members 20 and 20' are provided along top and bottom sections of each of the curved corner panels or sections 17 to enable them to be quickly assembled and disassembled in the same way as the other panels 11 and 12. In addition, the opposite end of each panel or section 17 is provided with a locking rib 24' and a locking groove 25'. These ribs and grooves enable the curved section or panel 17 to be quickly attached with other panel members 11 and 12 as required. Still further, the curved arcuate panel 17 has T-shaped slots similar to the slots 29 in the panels 11 and 12 so that the same ties 42 can be used interchangeably with these curved panels or sections 17. The ties are adapted to function and cooperate in the same way with the curved panel 17 as they do with the panels 11 and 12 and are also adapted to rest upon rib shoulders 54 prime in the same way as the ties 18 rest upon the shoulders of 54 as shown in FIG. 6. The shoulders 54' are shown in FIG. 2. In FIG. 2, it will be seen that the curved panel or sections 17 are continuously provided with castellations 20 and castellation grooves 20' along top and bottom surfaces and that a draftsman's convention has been utilized to show this arrangement even though the castellations 20 and grooves 20' have not been continuously drawn along top and bottom surfaces of the panel sections 17 illustrated in FIG. 2. The arrows in FIG. 2 show the way in which the panel sections are moved toward one another for effecting assembly. The slots for receiving the ends of the ties 18 are indicated at 29' in FIG. 2 and as stated are identical in construction and in manner of operation with the slots 29 previously described herein.

Figure 3:
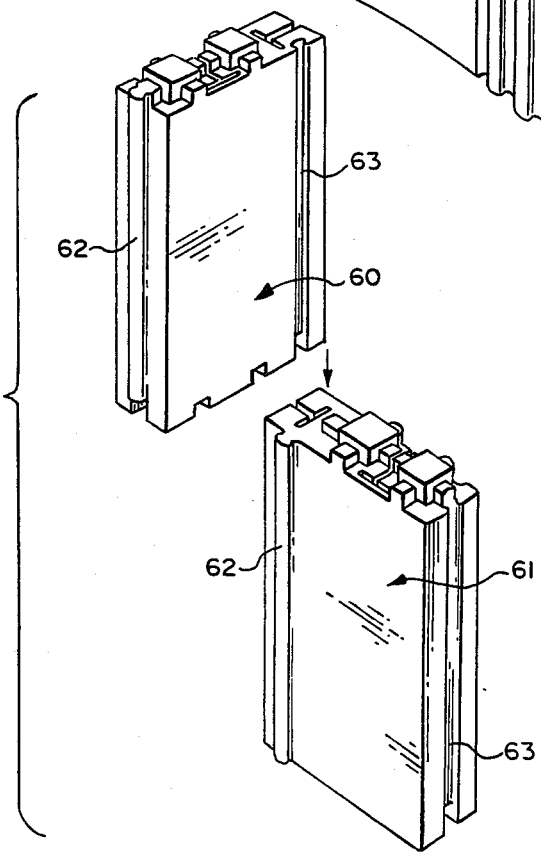
FIG. 3 is an enlarged exploded view of other corner components of my concrete formed structure.

The concrete form structure at the area of the corner can be of two different alternative constructions. One construction is illustrated in FIGS. 3–5 and the other is shown in 12. More particularly, the routed or curved corner section 17 can be cooperable with pairs of right angularly related inside corner sections or panels 60 and 61. These sections are illustrated in FIG. 3 and are further shown in FIG. 4 where in FIG. 4 the same sections are in assembled relation with forming sections 13 that make up the inside panel 12 of the concrete form structure 10. The inside corner sections or panels 60 and 61 are provided with ribs 62 and grooves 62 enable them to be secured with adjacent panels or sections 13 in the same way that the section 13 are secured to one another. Since it has been found to be more desirable to orient the sections in super imposed staggared relation relative to one another whether to be used and form a part of the panel 11 or the panel 12, it will be observed that the insie corner sections panels 60 and 61 are not intended nor adapted to be engaged directly with one another at a corner joint 64 (FIG. 4) but rather are adapted to be positioned above and below one another on opposite sides of the corner joint 64. It will further be seen in FIG. 3 that the corner sections or panel 60 and 61 are also provided with the same castellations and castellation grooves of a construction identical to those tha have been previously discussed and identified herein so that the castellations and castellation grooves on the corner sections or panel 60 and 61 can cooperate with other sections 13 in the same way as previously discussed.

In the formation of the inside right angular corner 64 it will be observed that some hand fitting and cutting of the sections may be required to produce a proper corner joint at 64. Such accustomed fitting can be easily be accomplished by using a hand saw and cutting through the foamed plastic that uniformly is used in the manufacture of all of these sections 13, 60, 61, etc. Since the castellations and the castellation grooves are uniformly spaced on all of these membes and the inside ribs 26 are uniformly spaced on the sections 13, the hand cutting of the various sections can be easily made so that the components can be readily reassembled even though it may be necessary to custom cut some of the sections to enable them to be properly engaged and fitted together at the area of the inside corner joint 64.

Figure 12:
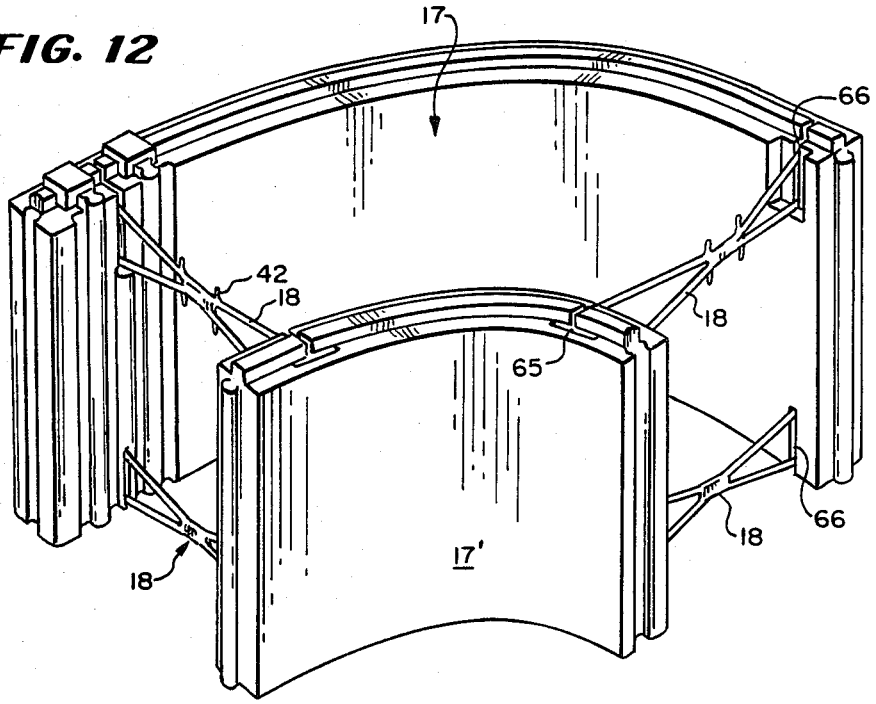
FIG. 12 is an enlarged prospective view of a modified type of corner form structure similar to FIG. 4 only illustrating the inside form as also being of a curved configuration.

As previously mentioned, the section 60 and 61 can be utilized to form an inside ring angled corner opposing the curved corner section 17. Optionally and alternatively the curved corner panel 17 can be secured with an inside corner panel 17' as illustrated in FIG. 12 by using a curved corner panel 17' it can be manufactured having a radius or shape similar to the outside corner panel 17. The inside curved corner panel 17' has castellations and castellation grooves and attaching ribs and grooves all similar to those provided on the curved outside panel 17 as is also provided on all of the other sections 13 so that ties 42 can be used to secure the various components or panels or sections of the concrete wall structure at regular predetermined intervals throughout the extent of the mold cavity provided in the use of the concrete form structure 10 so that the inside and outside panels can be rigidly connected in a reinfoced manner together and further so that concrete metal reinforcing bars can be used for reinforcing the concrete. These bars can be tied by metal wires to the plastic ties 42 to position the metal rods against movement as the concrete is poured into the cavity defined in the concrete mold structure 10. In order to assist in attaching the wall ties 18 between the curved outside corner panel 17 and the inside corner sectin or panel 60, it will be seen that the panel60 has T-shaped grooves 65 for receiving the wall tie 18. This arrangement is shown in FIGS. 5 and 6. Similarly the outside curved panel 17 has similar T-shaped slots 66 for receiving the opposite T-shaped end of the wall tie 18 all as previously described in connection with the manner in which the ties 18 are connected with opposed sections 13,13. The manner of function and operation of the slots 65 and 66with the ties 18 is the same as previously described since the construction of the slots 65 and 66 is identical with the other slots 29 as discussed before. It will further be seen from a study of FIGS. 4 and 5 that because the sections or panels 60 and 61 are positioned in staggered relation as shown in FIG. 4, that the ties 18,18 shown engaging the curved panel 17 in FIG. 5 are actually positioned in vertically spaced relation to one another. Also, indicia 59 are provided on the panels 11, 12, 13, 17, 60, 61 (not shown on 60 and 61) to assist in the alignment of fasteners with the ties 18 as discussed in my companion patent applications (supra).

Figure 8:
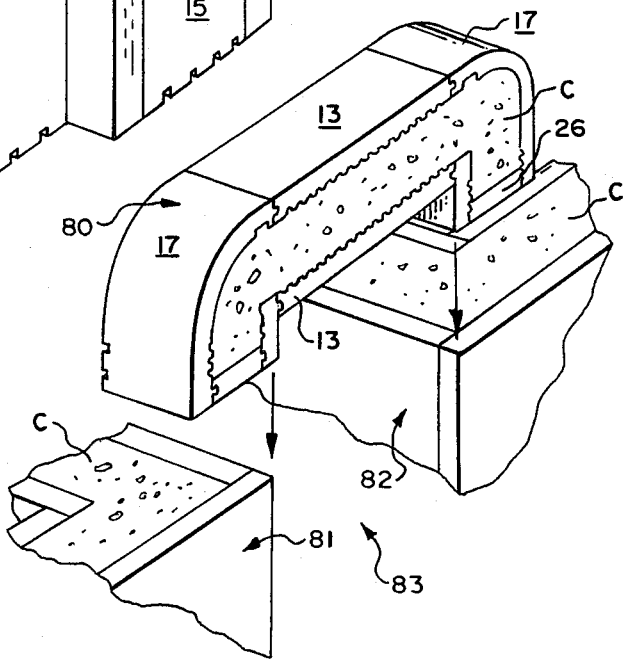
FIG. 8 is an enlarged fragmentary view showing the concrete form structure of FIG. 7 in exploded assembly with other building structure with concete in the the form and illustrating the way in which the components are assembled as illustrated by the arrows.
Figure 9:
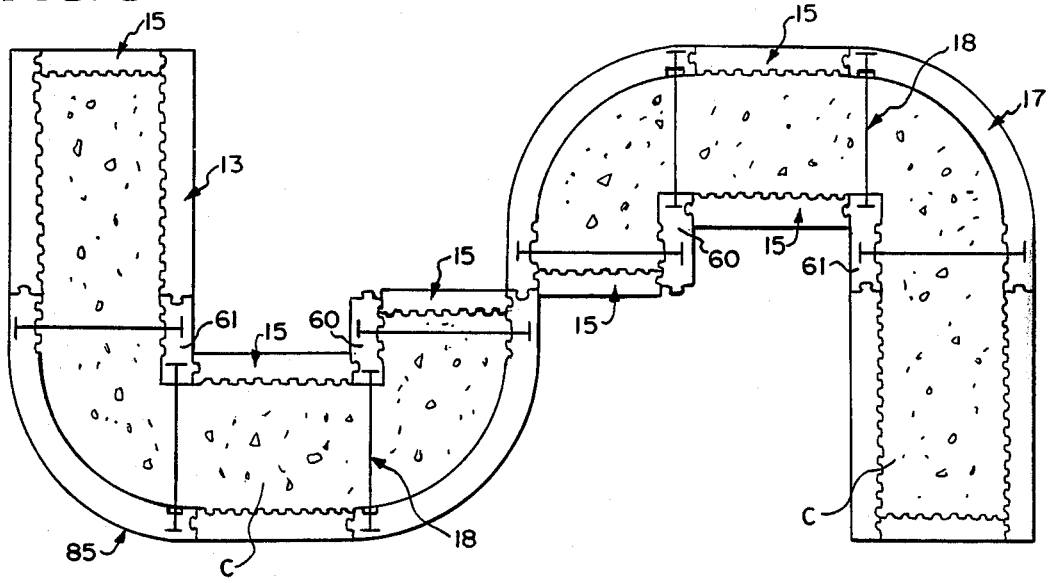
FIG. 9 is an enlarged fragmentary top plan view showing other ways in which the form structure of FIG. 7 can be used to produce other types of decorative and/or free forms.
Figure 10:
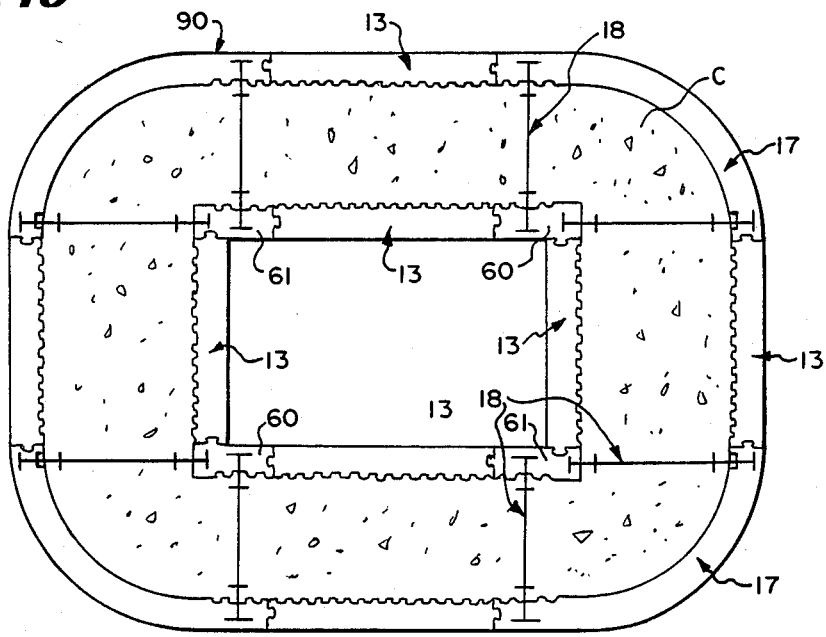
FIG. 10 is anenlarged top plan view of still another type of concrete form structure utilizing the curved corner components in yet another type of concrete form structure.

FIGS. 8, 9 and 10 illustrate how the various components of my modular concrete form structure including the curved corner panel 17 can be used in various assembled arrangements to build other types of forms for creating a variety of decorative and/or free forms as indicated at 80 as indicated in FIG. 7 and 8. The free form 80 constitutes an archway and is adapted to be supported on concrete wall structures 81 and 82 to provide a covered doorway 83 (FIG. 8)

Shown in FIG. 9 is another type of free form 85. As with the free form 80, the castellations 20 can be cut of by using a saw and the various components including the sections and panels and the corner panels can be all arranged to provide a decorative concrete wall structure 85.

In FIG. 10, the components have been arranged in another arrangement to provide a concrete wall structure 90 where the structure is in the form of an annualar enclosure or ring which can be used to form concrete columns for use in basements for buildings with this type of construction, panels forming the concrete wall structure can be vertically stacked to provide the highth required to build a column of a desired vertical dimension. Such an enclosurecould be used to manufacture decorative structures having different functions for use on patios or decks located between buildings in a mall area and the like.

Electric & Plumbing

Water supply lines and conduit for electric can be easily cut into the 2" thickness of the thermal wall, after the concrete has been poured. They are then covered with drywall or plaster. Pipes of greater diameter than 2", such as waste water pipes, should be placed in the wall cavity before the concrete is poured. Completely surrounded by concrete and thermal wall polystyrene, the pipe will be insulated and insensitive to frost even if the building is unheated.

The use of thermal wall blocks or sections 13 in construction makes possible the type of energy-efficient construction that is necessary today (and willbe even more so in the future judging from the ever-increasing energy costs).

EPS (Expandable Polystyrene) panels 11 and 12 are connected together with the plastic ties 18 to form building blocks. These blocks interlockhorizontally and vertically and are stacked one upon another to a desired height and filled with concrete.

The blocks remain in place after the concrete has been poured and provides the structure with an R-Value of 20.

R-Value means the resistance to heat loss and the R system is a way of rating insulation effectieness: the higher the R-Value the greater the resistance provided against heat and cold.

T.W.S. blocks are formed from ARCO-"Dylite", a fire retardant EPS, and will not support combustion.

There are no limits to the types of wall coverings, both interior and exterior that may be applied. Generally the exterior is of a cemeticious finish and the interior is plastered or drywalled. Panels may be glued or screwed.

SOME OF THE ADVANTAGES

1. Rated R-20+: Stretches Energy Dollars.
2. Concrete cures under ideal conditions, down to −10 degrees C. and use of the sections 13 operates to extend the building season.
3. By using the sections 13 in block form, heating and air conditioning costs can be reduced by 50%.
4. The sections 13 and the formed blocks are fire retardant and will not support combustion.
5. Sound Proof.
6. Water Repellant.
7. Mold and mildew resistant and rot proof.
8. The sections 13 have no food value and insects cannot digest it.
9. The sections 13 are versatile and can be used both above and below grade for residential, multi-family and commercial construction, as well as high-rise construction.
10. My forms are lightweight and the interlocking procedures enable increased productivity with less construction time.
11. The sections and the formed blocks are air tight and voids and air filtration are virtually eliminated.
12. Wall thickness may vary from 6, 8 or 10" based on length of ties.
13. The rounded corner sections allow for increased design possibilities with no additional framing costs.
14. There is a complete absence of cracking of internal and external finishes and maximum possible expansion is 0.2 mm/m.
15. Use of my concrete forms enable a quicker return on Investment Dollars.

LIMITATIONS (a) Loading:

Thermal wall panels should not be installed under surfaces subject to heavy point loading; the E.P.S. does not add structual integrity to the wall; it simply insulates it.

(b) Solvents:

E.P.S. sincluding thermal wall panels can not be exposed to petroleum-based solvents, fuels or coal tar products and their vapors.

(c) Ultraviolet Degredation:

Prolonged exposure to sunlite (Ultraviolet rays) will cause E.P.S. material to discolor and a dusting of the surface will occur. Wall panels must be covered to prevent degredation.

(d) Flammability:

The E.P.S. material used in forming thermal wall panels has a flame retardant additive but it should be considered combustable when directly exposed to a constant source of flame. It should no be installed near an open flame or other source of ignition. Current model building code requirements should be met for adequate protection.

A test study has been made of the exandable form panels 11 and 12 which reveals the improved characteristics of my panels, as follows:

TEST STUDY OF
IMPACT MODIFIED POLYPROPYLENE
SECTIONS ONLY FOR WINTER USAGE

| PROPERTY | UNIT | ASTM METHOD | PP6100BKR | PP6200BKR |
|---|---|---|---|---|
| Tensile Strength at 73° F. | psi | D638 | 3,900 | 3,600 |
| Elongation at Break | % | D638 | — | — |
| Flexural Strength at 73° F. | psi | D790 | 4,700 | 4,400 |
| Flexural Modulus (tangent) | psi × $10^5$ | D790 | 1.7 | 1.5 |
| Flexural Modulus (1% Secant) | psi × $10^5$ | | 1.6 | 1.4 |
| Izod Impact at 73° F. Notched (½" × ⅛" bar) | ft-lb/in. | D256(1) | 2.0 | 3.2 |
| Izod Impact at 73° F. Unnotched (½" × ⅛" bar) | ft-lb/in | D256 | 20 | 25 |
| Gardner Impact | in-lb | — | +160 | +160 |
| Heat Deflection Temperature, 264 psi | °F. | D648 | 120 | 115 |
| Heat Deflection Temperature, 66 psi | °F. | D648 | 195 | 190 |
| Specific Gravity | — | D648 | .905 | .905 |
| Hardness, Shore "D" | — | D2240 | 66 | 65 |
| Melt Flow | g/10 min. | D1238(2) | 6–8 | 4–6 |

-continued

| TEST STUDY OF IMPACT MODIFIED POLYPROPYLENE SECTIONS ONLY FOR WINTER USAGE | | | | |
|---|---|---|---|---|
| PROPERTY | UNIT | ASTM METHOD | PP6100BKR | PP6200BKR |
| Mold Shrinkage | in/in | — | .016 | .016 |

(1) Method A
(2) Condition "L"
Mold shrinkage is intended as a guide only, as specific shrinkage is affected by part design, mold design, and molding conditions.
The values listed herein are to be used as guides, not as specification limits. Determination of product suitability in any given application is the responsibility of the user.

It will be appreciated that suitable wall coverings and furring strips can be attached to the foam panels 11 and 12 in order to provide different types of decorative coverings, as disclosed in my co-pending application, Ser. No. 799,933.

Figure 11:
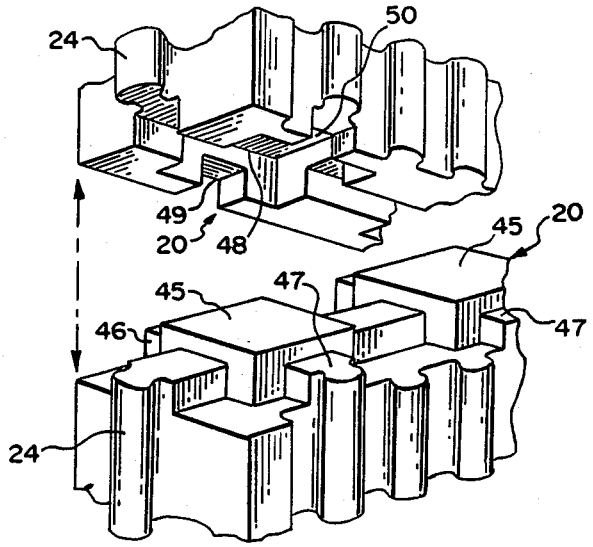
FIG. 11 is an enlarged fragmentary exploded view showing the way in which sections of the corner structure are adapted to be engaged utilizing an new and improved castellation arrangement.

According to other important features of my invention, the castellation structure includes a series of male castellations 20 and female castellations 20' which extend along upper and lower surfaces of each section 13 as illustrated in my patent drawings such as in FIGS. 2 and 11. The castellation structure comprises a main parallel sided block 45 integral with a pair of mini-parallel sided blocks 46 and 47 which project from opposite sides forwardly and rearwardly of the main parallel sided block 45. It will be further perceived that the castellation blocks 45 have a vertical height of ¾". The blocks 45, 46 and 47 all are integral and are spaced along a top edge of each panel 11 and 12. The castellation structure 20 further comprises the female castellations 20' which include a larger parallel sided block cavity 48 and a pair of smaller cavities 49 and 50 linked forwardly and rearwardly of the main cavity 48. These cavities are spaced along the botton edge of each panel 11 and 12 as seen in FIG. 11. The cavities 48, 49 and 50 have a configuration generally matching the shape of the blocks 45, 46 and 47 for nested press-fitted engagement together to provide a line seam.

Excellent results can be obtained where the main parallel sided block 45 has a vertical dimension of approximately ¾" while side blocks 46 and 47 have a vertical dimension of approximately ½". Still further, each side of the parallel sided block 45 preferably has a dimension of about 1" whereas the parallel sides of the small blocks 46 and 47 are preferably about ½". The corresponding surfaces in the cavities 48, 49 and 50 to be mated with the blocks 45, 46 and 47, the cavities are defined by surfaces that are matching to the block surfaces to be engaged therewith. In other words, the cavities constitute an exact negative of the blocks so that a so-called "hand and glove" fit can be obtained between them when they are press-fitted together. Thus, the cavities on the bottom edge of each panel have configurationsgenerally matching the shapes of the blocks for nested press-fitted engagement together.

Located between the castellation structures extending along the edges of the panels 11 and 12 are dams or dam blocks or ribs 51. These dams 51 have parallel vertical sides which extend approximately ½" above the top surface of the associated panel and have a width about ½". The dams 51 are linked at opposite ends with the main parallel sided blocks 45–45 and are secured in integral assembly together. These dams are alternated with the main blocks and extend along the length of the top edge of each panel. Corresponding dam or dam block or dam rib cavities 52 extend also along a bottom edge of each of the panels to provide a matching cavity so that the dam 51 can be received into the cavity 52. By providing a combined castellation structure and a dam or dam block arrangement between the panels, a superior concrete impervious seam can be established when the panels are in place for a concrete pour. It has been found that there is some tendency for the footing on which the concrete panels are laid where an unevenness does exist, then the position of the superimposed stacked panels can be out of line. It has been further found that where concrete is poured into the form, there is some tendency for the superimposed panels to "float" (FIG. 12) of S.N. 799,932 relative to one another so that the unevenness in the foundation can be compensated for where the superimposed panels become slightly disengaged in a so-called "float" state after concrete has been poured into the form. Where the engated castellation blocks and cavities are separated up to a distance of ½", the cavities and the blocks engaged therein and the dams 51 and the associated dam cavities 52 all act as a barrier to inhibit the flow of concrete through the impervious seam that exists between the joint (FIGS. 1 and 4) where the superimposed panels are engaged. Other types of structures have been used for attempting to secure superimosed panels together and concrete leakage through the joint has been a common problem that has existed in this art for some time. With my improved castellation structure and my dam structure between the castellations, the leakage can be prevented under normal operating conditions.

In connection with may work on the development of my modular synthetic plastic concrete form structure, I have observed that where concrete is poured into the form such as is illustrated in FIG. 10, that prior to my invention, there was a tendency for the concrete to jostle the concrete ties and in some instances to cause cracks in the polystyrene sections 13 which would damage the panel such that concrete leaks could occur at the cracks. In order to overcome this problem, and in accordance with other important features of my invention, I have found that by reducing the cross-sectional thickness of the panel to provide longitudinally spaced thinner panel areas 53 (FIG. 2) since the rib 29 terminates providing a shock absorbing shoulder 54 that is spaced ½" beneath the lower end of the T-shaped slot shoulder surface 55 on which the tie 18 rests. More specifically, the lower edge of the tie web section 37 is engaged on the shoulder 55 as seen in FIGS. 9 and 10 along with FIG. 2 show the gap relationship and spacing of ½" between the T-shaped lower edge surface 55 and the rib shoulder 54.

When the ties are properly positioned to hold the sections 13—13 in assembly together, FIG. 4 depicts the way in which the upper ties 18 are mounted in readiness for a concrete pour. In this connection, the lower edge of the tie rests upon the slot shoulder 55 and a gap relation exists between the lower edge of the tie and shoulder 54. In FIG. 5, after the reinforcing rods 44 have been place in position in the tie grooves 43 so as to be carried upon the ties 18, concrete on the top of the tie 18 and the concrete downwardly urges the ties 18 and causes the foam polystyrene to be compacted whereby the bottom surface of the tie slot 53 is compressed in a downward direction. This arrangement enables a dampening of the impact forces received by the ties, and the rib shoulders 54 provide stop means to further dampen the concrete shock forces applied to the tie 18 so that the ties can come to a rest position. As stated before, the reduced thickness of the sections 13 as indicated at 53 and the shoulder 54 act as a shock absorbing dampener to the shock imparted to the ties during a concrete pour. By using this arrangement, I have found that any tendency for the polystyrene section 10 to become cracked at the slots 29 can be substantially eliminated during normal operating conditions. In this respect, it will appreciate that the polystyrene acts like a sponge as the concrete is poured onto the ties so that the polystyrene sections 13 are compacted and the manner of compaction is illustrated by comparing FIGS. 9 and 10 shown in Serial No. 799,932.

It is thus seen, therefore, that there is provided a concrete wall structure which the objects of the invention are achieved and which are well adapted to meet all conditions of practical use.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In a modular synthetic plastic concrete form structure for forming a concrete wall having a curved corner the improvement of the structure including a pair of modular concrete impervious foamed forming panels each comprised of a series of modular foamed concrete forming sections stacked on top on one another and also disposed in end-to-end relation, the structure further including a foamed curved corner form structure comprised of a series of arcuately curved corner sections stacked on top of one another providing a radially outer continuous curved corner area for forming a curved concrete corner, the sections each have means on upper and lower edges and at opposite vertical edges for interlocking the sections in stacked end-to-end engagement with one another, the panels being positioned in spaced opposed relation, and ties connecting the panels in transversely spaced relation and with the panels and the ties being permanently attached upon concrete being poured between the panels whereupon the panels serve as a heat insulator and the ties serve as reinforcing for the concrete and for securing the tees and panels in permanent assembly together certain of the forming sections being of a flat shape, the means at opposite ends of the curved corner sections and at the ends of the flat forming sections comprising complimentarily shaped tongues and grooves slidingly engageable in locked assembly together, the oppositve vertical edges of the flat and the curved sections having vertically extending matching hook-shaped tongue and grooves enabling the sections to be engaged in end-to-end interlocked assembly to prevent disassembly except by sliding the engaged tongues and grooves longitudinally of one another.

2. The form structure of claim 1 further characterized by said tie means comprising vertically spaced rows of T-shaped tie slots in the opposed sections positioned in longitudinally spaced relation along the upper and lower edges and which slots are hidden from view when viewing outer surfaces of the stacked sections, synthetic plastic ties each having opposite enlarged T-shaped tie ends retainingly engaged in said T-shaped tie slots securing the sections in opposed spaced relation.

3. The form structure of claim 1 further characterized by said arcuately curved corner sections being of uniform length but with the ends of the stacked sections being offset relative to one another and secured in zigzag staggered relation with ends of the forming panels.

4. The form structure of claim 1 further characterized by said means at the upper and lower edges of said formed concrete forming sections excluding said arcuately curved corner sections including castellation structure each comprising a main parallel sided block and a pair of mini-side blocks projecting from opposite sides of the main parallel sided blocks, which blocks all are integral and are spaced along a top edge of each section, said castellation structure further comprising a series of cavities on a bottom edge of each section having a configuration generally matching the shape of said blocks for nested press fitted engagement together.

5. The concrete form structure of claim 1 further characterized by said tie means including a series of spaced tie slots being positioned along upper and lower edges of each panel and on its opposite sides an equidistant modular arrangement so that the panels can be interchangeably used with one another, and synthetic plastic ties having its opposite ends secured in said tie slots in associated opposed panels.

6. The concrete form structure of claim 1 further characterized by said means on upper and lower edges of the curved corner sections for interlocking them in engagement being modular on each section so that the curved corner sections can be interchangeably used with one another.

7. The concrete form structure of claim 2 further characterized by each of the ties having angular ends being formed in the shape of a T and with the tie slots also being in the shape of a T so that the T-shaped tie slots, all of the tie ends and all of the slots being shaped the same so that the ties an the slots are modular and interchangeable.

8. The concrete form structure of claim 2 further characterized by the ties each having triangular tie sections joined at apexes of the triangular tie sections, the tie sections each having triangular openings which are disposed in a common vertical plane for permitting concrete to flow freely through the openings when poured into the curved corner form structure.

9. The form structure of claim 1 where the curved corner sections are comprised of expanded, closed cell polystyrene having thermal insulation properties having an R-value of 20+.

10. The form structure of claim 1 further characterized by the curved corner including a series of forming sections positioned at right angle to one another providing a right angled corner joint radially inside of the arcuately curved corner sections.

11. The form structure of claim 1 further characterized by the curved corner including a second series of arcuately curved forming sections positioned radially inwardly of the curved corner in gap relation cooperable therewith to provide a mold for a concrete curved corner.

12. In a modular synthetic plastic concrete form structure for forming a concrete wall having a curved corner the improvement of the structure including a pair of modular concrete impervious foamed forming panels each comprised of a series of modular foamed concrete forming sections stacked on top on one another and also disposed in end-to-end relation, the structure further including a foamed curved corner form structure comprised of a series of arcuately curved corner sections stacked on top of one another providing a radially outer continuous curved corner area for forming a curved concrete corner, the sections each have means on upper and lower edges and at opposite vertical edges for interlocking the sections in stacked end-to-end engagement with one another, the panels being positioned in spaced opposed relation, and ties connectng the panels in transversely spaced relation and with the panels and the ties being permanently attached upon concrete being poured between the panels whereupon the panels serve as a heat insulator and the ties serve as reinforcing for the concrete and for securing the tees and panels in permanent assembly together, certain of the forming sections being of a flat shape, the means at the opposite ends of the curved corner sections and at the ends of the flat forming sections comprising complimentarily shaped tongues and grooves slidingly engageable in locked assembly together, the tongues and grooves being hook-shapedto resist being pulled apart in a direction at right angles to bottoms of said grooves.

13. The form structure of claim 1 where the flat and the curved sections and the closure panels are comprised of expanded, closed cell polystyrene having a density between 1.7 and 2.0.

14. In a modular synthetic plastic concrete form structure for forming a concrete wall having a curved corner, wherein the improvement comprises a pair of modular concrete impervious foamed forming panels each comprised of a series of modular foamed concrete forming sections stacked on top of one another and also disposed in end-to-end relation, a foamed curved corner form structure comprising a series of said forming sections positioned at right angles to one another providing a right angled corner joint, and arcuately curved corner sections stacked on top of one another providing a continuous curved corner radially outwardly of the right angled corner joint, the sections each having means on upper and lower edges and at opposite vertical edges for interlocking the sections in stacked end-to-end engagement with one another, the panels being positioned in spaced opposed relation, and tie means connecting the panels in transversely spaced relation and with the panels and the tie means permanently attached upon concrete being poured between the panels whereupon the panels serve as a heat insulator and the ties serve as reinforcing for the concrete and for securing the ties and panels in permanent assembly together, the modulator attachment means comprising complimentarily shaped tongues and grooves slidingly engageable and positioned in locked assembly, the tongues and grooves being hook-shaped to resist being pulled apart in a direction at right angles to bottoms of said grooves.

15. The concrete form structure of claim 14 further characterized by each of the ties having angular ends being formed in the shape of a T and with the tie slots also being in the shape of a T so that the T-shaped tie ends can retainingly engaged in the T-shaped tie slots, all of the tie ends and all of the slots being shaped the same so that the ties and the slots are modular and interchangeable.

16. The concrete form structure of claim 14 further characterized by the ties each having triangular tie sections joined at apexes of the triangular tie sections, the tie sections each having triangular openings which are disposed in a common vertical plane for permitting concrete to flow freely through the opening when poured into the form.

17. The form structure of claim 14 where the forming sections and the closure panels are comprised of expanded, closed cell polystyrene having thermal insulation properties having an R-value of 20+.

18. In a modular synthetic plastic concrete form structure for forming a concrete archway having a pair of curved corners, the improvement of the structure including a pair of modular foamed concrete forming sections disposed in spaced apart relation, curved corner sectionspositioned at opposite ends of one of the forming sections in secured assembly with the forming sections, the curved corner sections extending generally in angular relation to one another an in a direction extending in planes through another plane extending through the other of the forming sections, closure panel sections joining opposite ends of the corner section with the other of the forming sections providing an archway configuration, and ties connecting the forming sections and the curved corner sections with one another and with the ties being permanently attached upon concrerte being poured between the panels whereupon the panels serve as a heat insulator and the ties serve as reinforcing for the concrete and for securing the ties and panels in permanent assembly together.

19. The form structure of claim 18 further characterized by said tie means comprising vertically spaced rows of T-shaped tie slots in the opposed sections positioned in longitudinally spaced relation along the upper and lower edges and which slots are hidden from view when viewing outer surfaces of the stacked sections, synthetic plastic ties each having opposite enlarged T-shaped tie ends retainingly engaged in said T-shaped tie slots securing the sections in opposed spaced relation.

20. In a modular synthetic plastic concrete form structure for forming a concretewall having a curved corner, wherein the improvement comprises a pair of opposed modular concrete impervious forming panels comprised of a series of opposed modular concrete forming sections stacked on top on one another and also disposed in end-to-end relation, the sections each having means on its upper and lower edges and its opposite vertical edges for interlocking the sections in engagement with one another, the panels being positioned in spaced opposed relation, tie slots in the opposed sectins positioned in longitudinally spacedrows along the upper and lower edges, synthetic plastic reinforcing ties arranged in vertically spaced rows along upper and lower edges of the sections, the ties being positined in vertically spaced horizontally extending rows and the ties having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the ties and the forming sections having heights at substantial variance with respect to one another when said tiesare assembled in the rows at upper and loweredges of the forming sections leaving a substantial open area between the upper and lower rows of ties enabling concrete to be rapidly poured between the forming sections with low flow impedance from the ties, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall, the structure further includinga foamed curved corner form structure comprised of a series of arcuately curved corner sections stacked on top of one another providing a radially outer continuous curved corner area for forming a concrete wall with a curved corner, the sections each have means on upper and lower edges and at opposite vertical edges for interlocking the sections in stacked spaced opposed relation, the ties connectng the panels in transversely spaced relation and with the panels and the ties being permanently attached upon concrete being pouredbetween the panels whereupon the panels serve as a heat insulator and the ties serve as reinforcing for the concrete and for securing the ties and panels in permanent assembly together.

21. The concrete form structure of claim 20 further characterized by the tie slots being positioned along upper and lower edges of each panel and on its opposite sides an eqidistant modular arrangement so that the panels can be interchangeably used with one another.

22. The concrete form structure of claim 20 further characterized by each of the ties having angular ends being formed in the shape of a T and with the tie slots also being in the shape of a T so that the T-shaped tie ends can be retainingly engaged in the T-shaped tie slots, all of the tie ends and all of the slots being shaped the same so that the ties and the slots are modular and interchangeable.

23. In a modular synthetic plastic concrete form structure, wherein the improvement comprises a pair of modular concrete impervious synthetic plastic forming panels each comprised of a series of opposed modular arcuately shaped concrete forming sections stacked on top of one another and also disposed in end-to-end relation, the sections each having longitudinally spaced castellation means including castellation blocks and castellation block receiving cavities on its upper and lower edges along a joint betweenthe sections for enabling superimposed sections to be press-fitted by hand pressure enabling the sections to be vertically stacked upon one another in interlocked assembly, the castellation means having concrete dam means for enabling the stacked sections to be slightly separated relative to one another without creating a leakage path for concrete to seep through the joint between the longitudinally extending edges of the sections, said dam means comprising a dam block integrally linked at opposite ends to said castellation means in assembly together and a correspondingly shaped dam block cavity, the dam block cavity being shaped for mated press-fitted engagement with the dam block when the concrete section forming sections are disposed in superimposed assembly together, the castellation block having a greater height than the dam block to allow stacked sections to separate slighltly along said joint and yet prohibit leakage through the joint while the sections are maintained in interlocked assembly.

24. The form structure of claim 23 further characterized by the castellation means each comprising a main parallel sided block and a pair of mini-parallel sided blocks projecting from opposite sides of the main parallel sided blocks, which blocks all are integral and are spaced along a top edge of each panel, said castellation structure further comprising a series of cavities on a bottom edge of each panel having a configuration generally matching the shape of said blocks for nested press-fitted engagement together, said dam means comprising a dam block integrally linked at opposite ends to said main blocks in assembly together and a correspondingly shaped dam block cavity linked and connected to the main block cavities which are positioned at opposite ends of the dam block, the dam block cavity being shaped for mated press-fitted engagement with the dam block when the concrete forming sections are disposed in superimposed assembly together.

25. The form structure of claim 23 further characterized by said castellation means each comprising a main parallel sided block integral and a pair of mini-parallel sided blocks projecting from opposite sides of the main parallel sided blocks, which blocks all are integral and are spaced along a top edge of each panel, said castellation structure further comprising a series of cavities on a bottom edge of each panel having a configuration generally matching the shape of said blocks for nested press-fitted engagement together.

26. In a modular synthetic plastic concrete form structure for forming a concrete wall having a curved corner, wherein the improvement comprises a pair of modular concrete impervious synthetic plastic forming panels comprised of a series of opposed modular linear concrete forming sections stacked on top on one another and also disposed in end-to-end relation, the structure further including a foamed curved corner form structure comprised of a series of arcuately curved corner sections stacked on top of one another providing a radially outer continuous curved corner area for forming a curved concrete corner, the linear and curved sections each having longitudinally spaced castellation means on its upper and lower edges for enabling superimposed sections to be press-fitted by hand pressure enabling the sections to be vertically stacked upon one another in interlocked assembly, concrete form ties securing the opposed sections together, the tis each having opposite T-shaped tie ends, longitudinally spaced T-shaped slots providedalong upper edges of the panels with the T-shaped tie end received therein, and means at opposite ends of the linear and curved sections comprising complimentarily shaped tongues and grooves slidingly engageable in locked assembly together, the opposite ends of the linear and curved sections having vertically extending matching hook-shaped tongue and grooves enabling the sections to be engaged in end-to-end interlocked assembly to prevent disassembly except by sliding the engaged tongues and grooves longitudinally of one another.

27. In a modular synthetic plastic concrete form structure for forming a concrete wall having a curved corner the improvement of the structure including a pair of modular concrete impervious foamed forming panels each comprised of a series of modular foamed concrete forming sections stacked on top on one another and also disposed in end-to-end relation, the structure further including a foamed curved corner form structure comprised of a series of arcuately curved corner sections stacked on top of one another providing a radially outer continuous curved corner area for forming a curved concrete corner, the sections each have means on upper and lower edges and at opposite vertical edges for interlocking the sections in stacked end-to-end engagement with one another, the panels being positioned in spaced opposed relation, and ties connecting the panels in transversely spaced relation and with the panels and the ties being permanently attached upon concrete being poured between the panels whereupon the panels serve as a heat insulator and the ties serve as reinforcing for the concrete and for securing the tees and panels in permanent assembly together, attached upon concrete being poured between the panels whereupon the panels serve as a heat insulator and the ties serve as reinforcing for the concrete and for securing the tees and panels in permanent assembly togetheer, said means at the upper and lower edges of said formed concrete forming sections excluding said arcuately curved corner sections including castellaton structure each comprising a main parallel sided block and a pair of mini-side blocks projecting from opposite sides of the main parallel sided blocks, which blocks all are integral and are spaced along a top edge of each section, said castellation structure further comprising a series of cavities on a bottom edge of each section having a configuration generally matching the shape of said blocks for nested press fitted engagement together.

* * * * *